US007619601B2

(12) United States Patent
Yamada et al.

(10) Patent No.: US 7,619,601 B2
(45) Date of Patent: Nov. 17, 2009

(54) DISPLAY DEVICE AND DISPLAY METHOD

(75) Inventors: Mizuki Yamada, Kanagawa (JP); Yoshiharu Nakajima, Kanagawa (JP); Yoshitoshi Kida, Kanagawa (JP)

(73) Assignee: Sony Corporation, Tokyo (JP)

( * ) Notice: Subject to any disclaimer, the term of this patent is extended or adjusted under 35 U.S.C. 154(b) by 694 days.

(21) Appl. No.: 11/295,760

(22) Filed: Dec. 6, 2005

(65) Prior Publication Data

US 2006/0119627 A1 Jun. 8, 2006

(30) Foreign Application Priority Data

Dec. 8, 2004 (JP) ..... P2004-356066

(51) Int. Cl.
*G09G 3/36* (2006.01)

(52) U.S. Cl. ..... 345/89; 345/691; 345/692; 345/693

(58) Field of Classification Search ..... 345/89, 345/691–693
See application file for complete search history.

(56) References Cited

U.S. PATENT DOCUMENTS 6,542,141 B1 * 4/2003 Mano et al. ..... 345/89

FOREIGN PATENT DOCUMENTS

JP 07-120725 5/1995

* cited by examiner

*Primary Examiner*—Richard Hjerpe
*Assistant Examiner*—Leonid Shapiro
(74) *Attorney, Agent, or Firm*—K&L Gates LLP

(57) ABSTRACT

A display device and display method are provided. The display device and the display method can prevent generation of noise in delta array pixels of an FRC method, and able to prevent a lowering of an image quality, that is, a display device of predetermined array pixels displaying a ($2n$+1) gradation by alternately displaying a $2n$ gradation and a ($2n$+2) gradation, comprising a modulation pattern generation circuit for generating a spatial/temporal modulation pattern switching a temporal modulation pattern every frame (F) and changing an order of application of a spatial modulation pattern every NF (N is an even number); a data processing circuit for modulating image data in accordance with the modulation pattern generated by the modulation pattern generation circuit; and a drive circuit for driving the display in accordance with the modulated data of the data processing circuit.

9 Claims, 17 Drawing Sheets

PRIOR ART

PRIOR ART

PRIOR ART

STRIPE ARRAY

PRIOR ART

FIG. 4A

| | | | | | |
|---|---|---|---|---|---|
| R1 | G1 | B1 | R2 | G2 | B2 |
| R1 | G1 | B1 | R2 | G2 | B2 |
| R1 | G1 | B1 | R2 | G2 | B2 |
| R1 | G1 | B1 | R2 | G2 | B2 |

FIG. 4B

| | | | | | |
|---|---|---|---|---|---|
| R1 | G1 | B1 | R2 | G2 | B2 |
| R1 | G1 | B1 | R2 | G2 | B2 |
| R1 | G1 | B1 | R2 | G2 | B2 |
| R1 | G1 | B1 | R2 | G2 | B2 |

PRIOR ART

DELTA ARRAY

PRIOR ART

SPATIAL MODULATION PATTERN IN PRESENT EMBODIMENT 1.5 DOT

SPATIAL MODULATION PATTERN OF FIG. 5B

6 DOTS

SPATIAL MODULATION PATTERN IN PRESENT EMBODIMENT

1 LINE

SPATIAL MODULATION PATTERN OF FIG. 5B

1 LINE

FIG. 11A CASE WHERE SPATIAL MODULATION PATTERN IS SWITCHED FOR EVERY 2F (15 HZ)

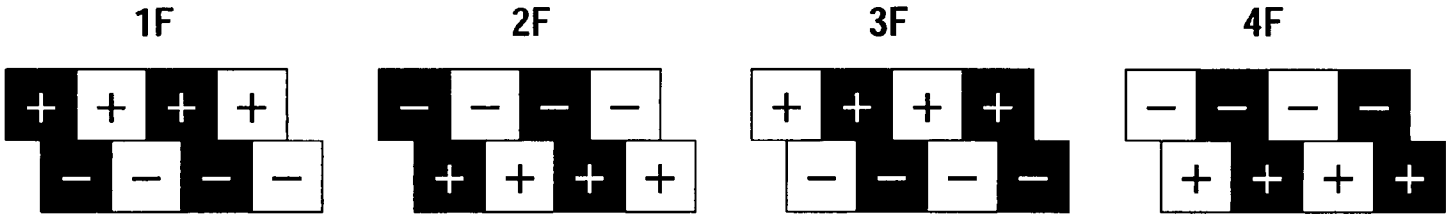

+ AND – IN THE FIGURE REPRESENT VCOM POLARITIES

•WHEN PATTERN IS SWITCHED FOR EVERY 2F (15 Hz) SO THAT OPTIMUM VCOM DOES NOT DEVIATE, SWITCHING OF PATTERN IS RECOGNIZED AND NOISE IS GENERATED

FIG. 11B CASE WHERE SPATIAL MODULATION PATTERN IS SWITCHED FOR EVERY 1F (30 HZ)

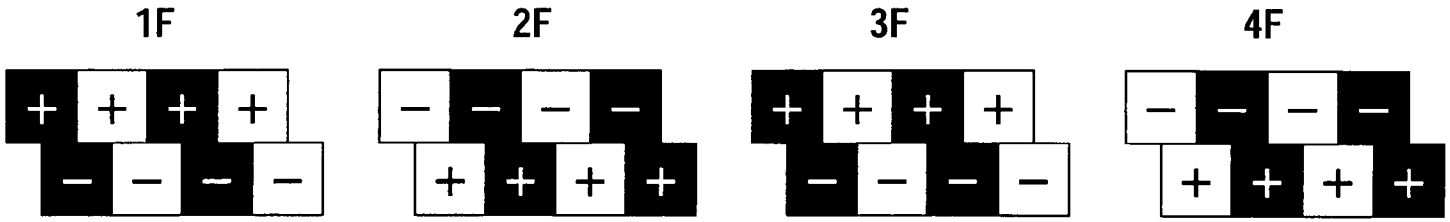

•WHEN PATTERN IS SWITCHED FOR EVERY 1F (30 Hz), PATTERN IS SEEN WITH SWITCHING NOT RECOGNIZED
•HOWEVER, DUE TO DEVIATION FROM OPTIMUM VCOM AND ADDITION OF DC OFFSET TO LIQUID CRYSTAL, BURN-IN IS CAUSED

•WHEN FRC IS NOT USED, V0/2 BECOMES OPTIMUM VCOM, BUT WHEN FRC IS USED, OPTIMUM VCOM WILL BE DEVIATED BY EXACTLY (V0-V1)/2

•WHERE FRC IS NOT USED, V0 IS APPLIED TO LIQUID CRYSTAL WITH RESPECT TO VCOM, BUT WHEN FRC IS USED, CONSTANT DC OFFSET WILL BE APPLIED TO VCOM AND BECOMES CAUSE OF BURN-IN

S14
MODULATION SIGNAL PATTERN

MCK

DMP
DOT MODULATION SIGNAL PATTERN

DT
((2N+1) GRADATION DISPLAY DATA)
R1 G1 B1 R2 G2 G2

S15
MODULATED DATA
R1 G1 B1 R2 G2 G2
MODULATED DATA INDICATES GRADATION DISPLAY DATA DESCRIBED RIGHT
2n GRADATION DISPLAY DATA
(2n+2) GRADATION DISPLAY DATA

DISPLAY DEVICE AND DISPLAY METHOD

CROSS REFERENCES TO RELATED APPLICATIONS

The present invention claims priority to Japanese Patent Application No. 2004-356066 filed in the Japan Patent Office on Dec. 8, 2004, the entire contents of which being incorporated herein by reference.

BACKGROUND

The present invention relates to a display device using a frame rate control (FRC) method to control gradations of pixels, more particularly relates to a display device and a display method of stripe array and delta array pixels alternately displaying a 2n gradation and a (2n+2) gradation so as to display a (2n+1) gradation.

The FRC method employed in for example a liquid crystal display device is a method of expressing gradations which displays different gradations for every frame in order to expressing an intermediate gradation.

FIGS. 1A and 1B are diagrams for explaining the principle of the FRC method. In the FRC method, as shown in FIG. 1A, a 2n gradation ($n \geqq 0$) is displayed in a first frame (1F) and a (2n+2) gradation is displayed in a second frame (2F). When repeating this for every frame, as shown in FIG. 1B, a (2n+1) gradation can be expressed. However, since the display is substantially driven at 30 Hz as it is irrespective of it being designed to be driven at 60 Hz, the display ends up appearing to flicker.

Therefore, spatial and temporal processing as shown in FIG. 2 is performed to cancel this out. Specifically, when looking at a certain pixel, the same gradation is not displayed at the adjacent pixels.

However, in 1H1FVCOM inverted drive in which an counter electrode performs an inverted operation for every 1H (1 horizontal period) and for every 1F, if constantly driving the display as shown in FIG. 2, when looking at a certain pixel, the polarity (provisionally indicated by + and −) is written as only +(−) polarity at the time of the 2n gradation display and as only − (+) polarity at the time of the (2n+2) gradation display. The optimum VCOM shifts or a DC component is added to the liquid crystal, therefore the phenomenon of burn-in occurs.

Accordingly, as shown in FIG. 3, when looking at one pixel, this can be avoided by switching the spatial modulation pattern for every 2F so that the pattern of the 2n gradation display and the pattern of the (2n+2) gradation display appear equal including the polarity of the signal (see for example Japanese Unexamined Patent Publication (Kokai) No. 7-120725).

As a pixel array to which the FRC method is applied, there are a stripe array and a delta array.

FIGS. 4A and 4B are diagrams of patterns on a display screen in a stripe array in a case of processing data using the same spatial modulation pattern in a stripe array and a delta array. FIGS. 5A and 5B are diagrams of patterns on a display screen in a delta array a case of processing data using the same spatial modulation pattern in a stripe array and a delta array.

In a stripe array, there is no pixel displaying the same gradation as an adjacent pixel. In the case of a delta array, however, the pixels are offset by 1.5 dots for every row, therefore there is always a pixel displaying the same gradation as an adjacent pixel. Particularly, the pattern in the delta array in FIGS. 5A and 5B suffers from vertical noise and lowers the image quality. Further, these phenomena are conspicuous when the pixel pitch is large due to visual characteristics and when the difference of potentials used for the 2n gradation and the (2n+2) gradation is large.

SUMMARY

It is therefore desirable to provide a display device and a display method able to prevent generation of noise in delta array pixels of the FRC method and able to prevent a drop in the image quality.

According to a first aspect of an embodiment of the present invention, there is provided a display device of predetermined array pixels displaying a (2n+1) gradation by alternately displaying a 2n gradation and a (2n+2) gradation, comprising a modulation pattern generation circuit for generating a spatial/temporal modulation pattern switching a temporal modulation pattern every frame (F) and changing an order of application of a spatial modulation pattern every NF (N is an even number); a data processing circuit for modulating image data in accordance with the modulation pattern generated by the modulation pattern generation circuit; and a drive circuit for driving the display in accordance with the modulated data of the data processing circuit.

According to a second aspect of an embodiment of the present invention, there is provided a display device of predetermined array pixels displaying a (2n+1) gradation by alternately displaying a 2n gradation and a (2n+2) gradation, comprising a display unit in which pixels including liquid crystal cells are arrayed in a matrix and the pixels are connected to a data line; a modulation pattern generation circuit for generating a spatial/temporal modulation pattern switching a temporal modulation pattern every frame (F) and changing an order of application of a spatial modulation pattern every NF (N is an even number); a data processing circuit for modulating image data in accordance with the modulation pattern generated by the modulation pattern generation circuit; and a drive circuit for driving the display by driving the data line in accordance with the modulated data of the data processing circuit.

Preferably, the modulation pattern generation circuit switches the temporal modulation pattern every frame and changes the order of application of the spatial modulation pattern every NF (N is an even number) in synchronization with a horizontal drive clock supplied for every horizontal period (H) and a vertical drive clock supplied for every frame (F).

Preferably, the data processing circuit generates a dot modulation signal pattern based on the modulation pattern supplied by the modulation pattern generation circuit in synchronization with a predetermined clock and adds this dot modulation pattern to the input image data to generate modulated data.

According to a third aspect of an embodiment of the present invention, there is provided a method of display of predetermined array pixels displaying a (2n+1) gradation by alternately displaying a 2n gradation and a (2n+2) gradation, comprising the steps of generating a spatial/temporal modulation pattern switching a temporal modulation pattern every frame (F) and changing an order of application of the spatial modulation pattern every NF (N is an even number), modulating the image data in accordance with the generated modulation pattern, and driving the display in accordance with the modulated data.

According to the embodiment of the present invention, in for example the modulation pattern generation circuit, when looking at a certain data line, the modulation pattern is generated so that the gradation assigned switches for every 2H, then switches for every 1F, then switches for every 128F. Further, the data processing circuit generates a dot modulation pattern combined with a predetermined clock so that for example the gradation is assigned for each data and adds this to the data to modulate the (2n) gradation display data to the (2n+2) gradation display data.

According to the embodiment of the present invention, there is the advantage that a display free from noise, without a deviation of the optimum VCOM, and without burn-in is possible. Further, there is no need to use a sophisticated spatial modulation pattern, therefore a memory that shifts the spatial modulation pattern for each field or generates it at random is unnecessary.

Additional features and advantages are described herein, and will be apparent from, the following Detailed Description and the figures.

BRIEF DESCRIPTION OF THE FIGURES

FIGS. 4A and 4B are diagrams of patterns on a display screen in a stripe array when processing data by using the same spatial modulation pattern in a stripe array and a delta array.

FIG. 11 is a diagram showing a relationship between a temporal modulation pattern and a VCOM polarity.

DETAILED DESCRIPTION

Preferred embodiments of the present invention will be described in detail below with reference to the attached drawings.

Figure 6:
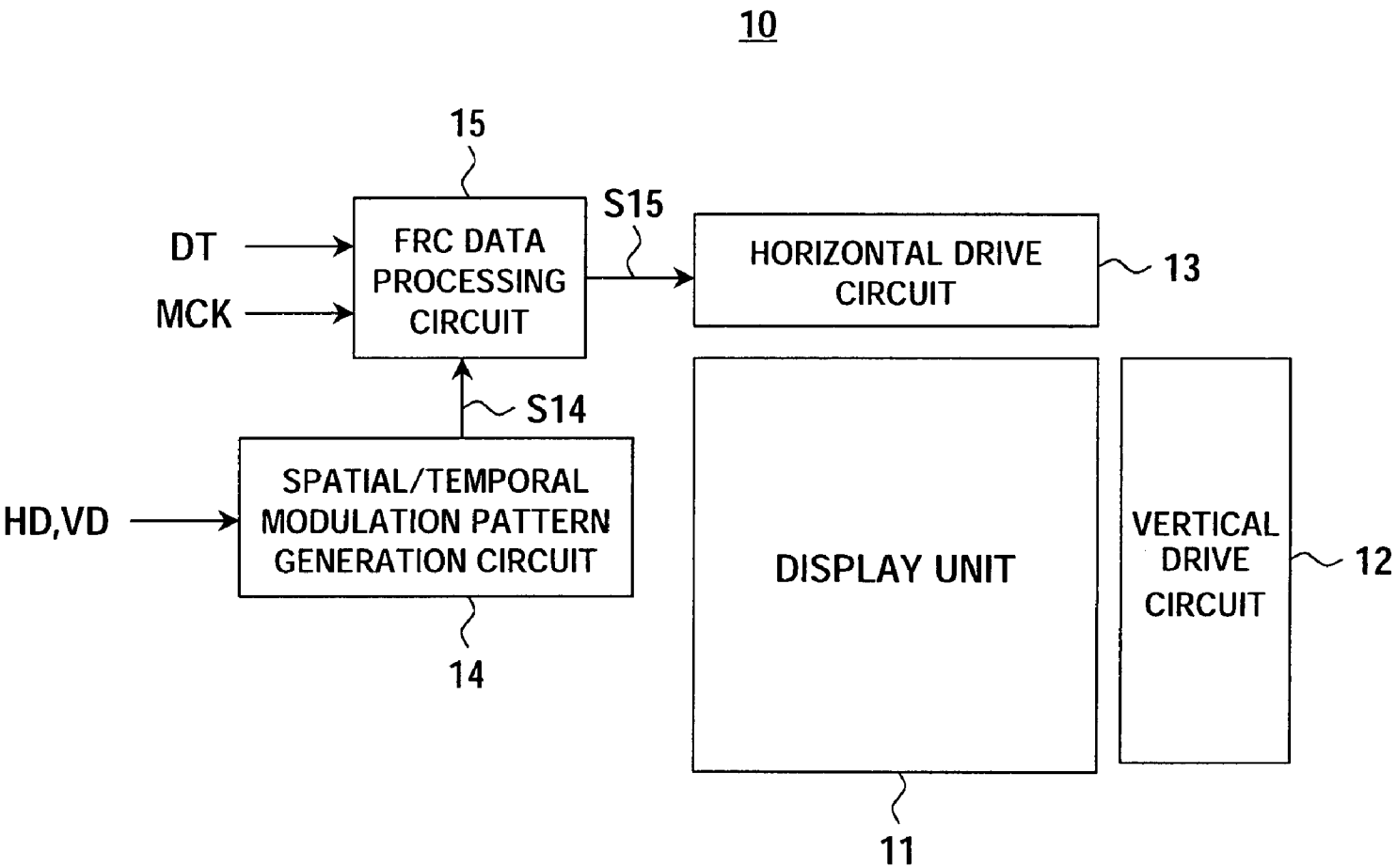
FIG. 6 is a circuit diagram of a liquid crystal display device according to an embodiment of the present invention.

FIG. 6 is a circuit diagram showing a liquid crystal display device according to an embodiment of the present invention.

A liquid crystal display device 10 according to the present embodiment employs the FRC method. As will be explained in detail later, it is configured so as to set the optimum spatial modulation pattern (temporal modulation pattern) of the delta array, switch this temporal modulation pattern every 11 frames (F), and change the order of application of the spatial modulation pattern every NF (N is an even number) so as to enable drive where the optimum VCOM does not shift overall in (2N)F and the DC offset is also cancelled and to enable the optimum drive without lowering the image quality when using the FRC in delta array pixels. Note that the present invention can be applied to the display of not only delta array pixels, but also stripe array pixels and that an effect such as noise elimination can be obtained. In the following description, however, the explanation will be given by taking as an example a case where the optimum spatial modulation pattern of the delta array pixels is set.

The liquid crystal display device 10, as shown in FIG. 6, has an active display area 11, a vertical drive circuit (gate driver) 12, a horizontal drive circuit (source driver) 13, a spatial/temporal modulation pattern generation circuit 14, and an FRC data processing circuit 15 as principal components. These active display area 11, vertical drive circuit 12, horizontal drive circuit 13, spatial/temporal modulation pattern generation circuit 14, and FRC data processing circuit 15 are formed integrated on a transparent insulating substrate, for example, a glass substrate.

The active display area 11 has a plurality of pixels including liquid crystal cells arrayed in a matrix.

Figure 7:
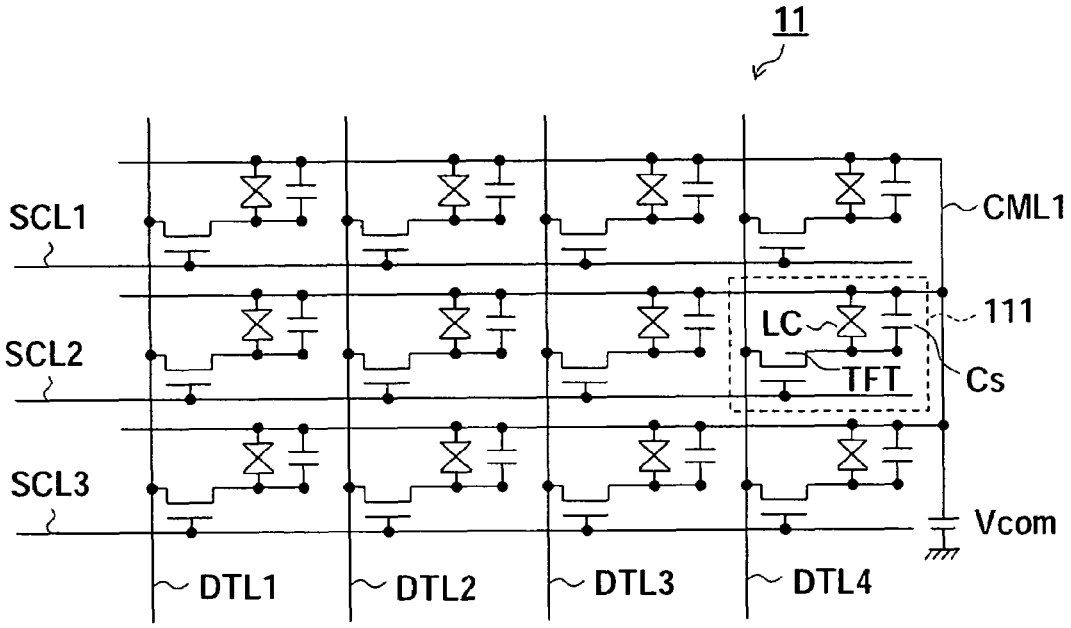
FIG. 7 is a circuit diagram of an example of the configuration of an active display area.

FIG. 7 is a circuit diagram showing a specific example of the configuration of the active display area 11. Note that, in FIG. 7, for simplification of the drawing, a case of a pixel array of three rows and four columns is shown as the example. In FIG. 7, in the active display area 11, vertical scan lines SCL1 to SCL3 and data lines DTL1 to DTL4 are laid in a matrix, and unit pixels 111 are arranged at their intersecting portions.

Each unit pixel 111 has a pixel transistor constituted by a thin film transistor TFT, a liquid crystal cell LC, and a holding capacitor Cs. The thin film transistors TFT are connected at their gate electrodes to the corresponding vertical scan lines SCL1 to SCL3 of the matrix array and are connected in their source electrode to the corresponding data lines DTL1 to DTL4 of the matrix array. Each liquid crystal cell LC is connected at its pixel electrode to a drain electrode of the thin film transistor TFT and connected at its counter electrode to a common line CML1. The holding capacitor Cs is connected between the drain electrode of the thin film transistor TFT and the common line CML1. The common line CML1 is supplied with a predetermined alternating current voltage as a common voltage VCOM.

First ends of the vertical scan lines SCL1 to SCL3 are connected to output ends of corresponding rows of the vertical drive circuit 12 shown in FIG. 6. The vertical drive circuit 12 is configured by for example a shift register and sequentially generates vertical selection pulses in synchronization with a vertical transfer clock VCK and applies the same to the vertical scan lines SCL1 to SCL3 for performing a vertical scan.

First ends of the data lines DTL1 to DTL4 are connected to the output ends of columns corresponding to the horizontal drive circuit 13 shown in FIG. 6. The horizontal drive circuit 13 is configured by a shift register, a latch circuit, a digital/analog converter (DAC), etc. as principal components.

The horizontal drive circuit 13 sequentially outputs shift pulses from transfer stages in synchronization with a horizontal transfer clock HCK in the shift register to perform horizontal scan, point sequentially samples and latches predetermined bits of digital image data given from the data processing circuit 15 in response to a sampling pulse from the shift register in a sampling latch circuit, latches digital image data latched in the point sequence in a line sequence latch circuit again in 1-line units for line sequencing, converts 1 line's worth of the digital image data to an analog image signal at the DAC, and outputs the same to the corresponding data lines DTL1 to DTL4.

Figure 8:
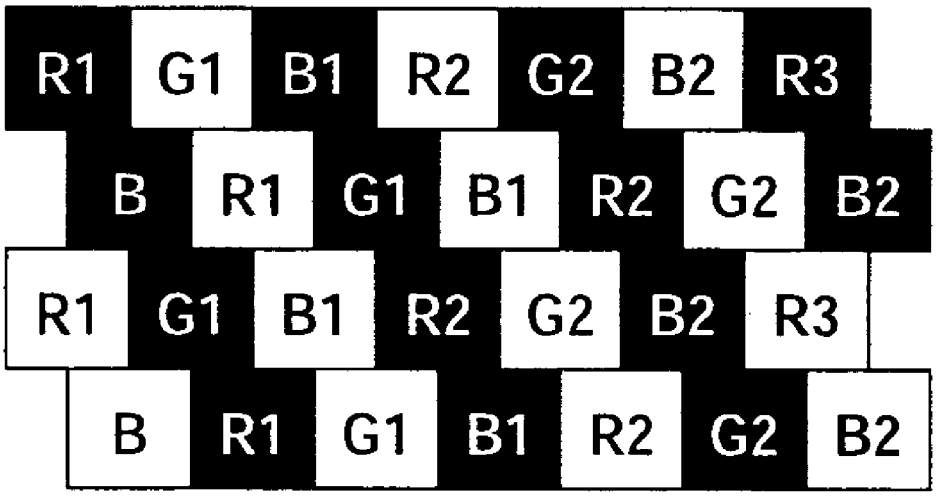
FIG. 8 is a diagram showing a spatial modulation pattern in which a spatial frequency of a horizontal direction pattern and a spatial frequency of a vertical direction pattern in delta array pixels are made to become the highest and noise is prevented from being recognized.

The spatial/temporal modulation pattern generation circuit 14 receives a horizontal drive clock HD supplied for every 1H and a vertical drive clock VD supplied for every frame, generates a spatial/temporal modulation pattern corresponding to the delta array pixels as shown in FIG. 8, and outputs the same to the data processing circuit 15.

The spatial/temporal modulation pattern generation circuit 14 generates a spatial/temporal modulation pattern switching the temporal modulation pattern at 1F and changing the order of application of the spatial modulation pattern at NF (N is an even number) in synchronization with the horizontal drive clock HD supplied for every 1H and the vertical drive clock VD supplied for every 1F so as to enable driving so that there is no deviation in the optimum VCOM in total in (2N)F and the DC offset is cancelled and supplies the same as a modulation signal pattern S14 to the FRC data processing circuit 15.

Below, the reason for generating a spatial/temporal modulation pattern switching the temporal modulation pattern at 1F and changing the order of application of the spatial modulation pattern at NF (N is an even number) in synchronization with the horizontal drive clock HD supplied for every 1H and the vertical drive clock VD supplied for every 1F in FRC of delta array pixels so as to enabling driving so that there is no deviation in the optimum VCOM in total in (2N)F and the DC offset is cancelled in the present embodiment will be explained.

FIG. 8 is a diagram showing a spatial modulation pattern designed so that the spatial frequency of the horizontal direction pattern and the spatial frequency of the vertical direction pattern become the highest and noise cannot be recognized in delta array pixels. In a stripe array, the number of dots in the horizontal direction and the number of lines in the vertical direction required for displaying the average luminance are 1 dot/1 line. The pattern shown in FIG. 4 corresponds to that. In a delta array, the number of dots in the horizontal direction and the number of lines in the vertical direction required for displaying the average luminance are 1.5 dots/1 line. When the pattern is formed in that way, it becomes as shown in FIG. 8.

Figure 1A:
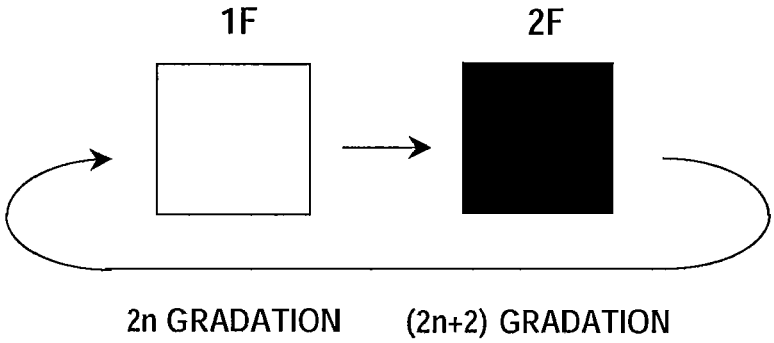
PRIOR ART FIG. 1A
FIGS. 1A and 1AB are diagrams for explaining a principle of an FRC method.
Figure 1B:
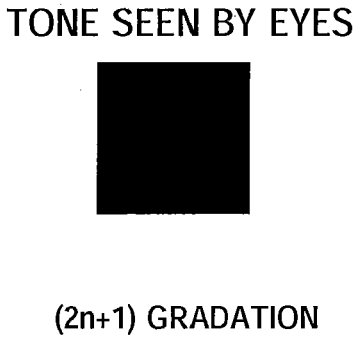
Figure 2:
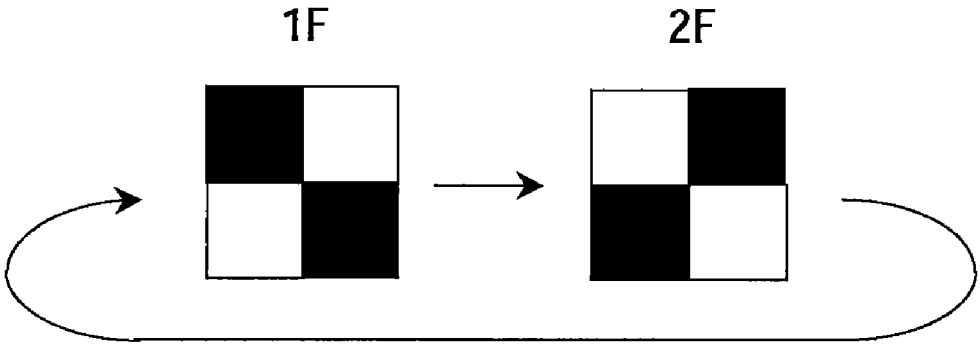
FIG. 2 is diagram for explaining the FRC method applying spatial and temporal processing so as to cancel out flicker.
Figure 3:
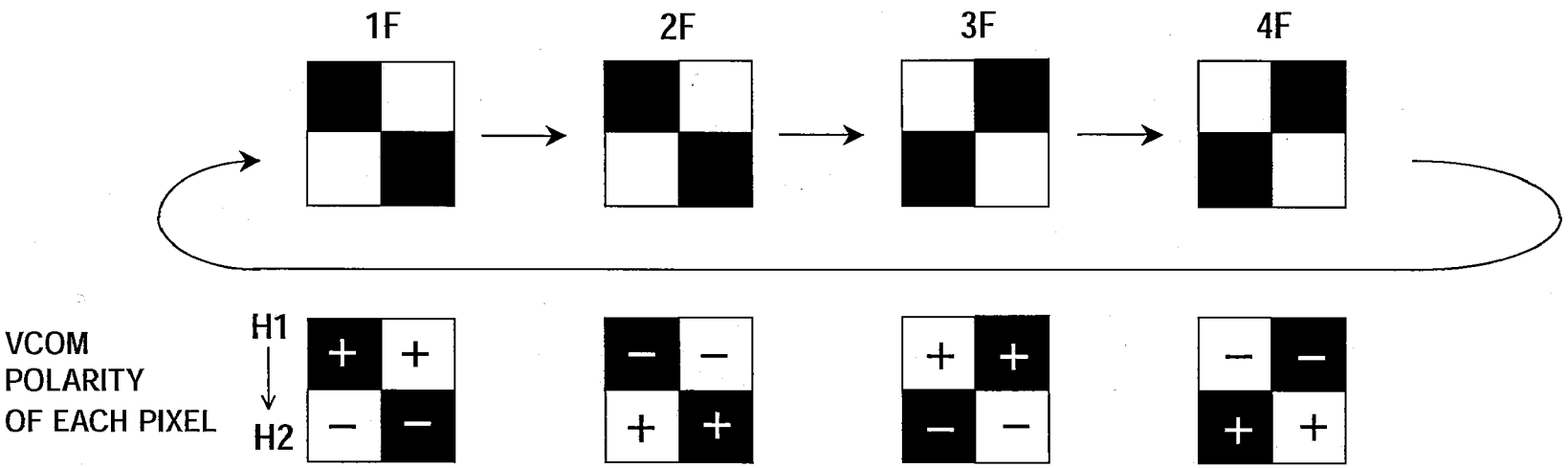
FIG. 3 is a diagram for explaining the FRC method performing spatial and temporal processing and using a pattern designed so that the optimum VCOM does not shift.
Figure 5A:
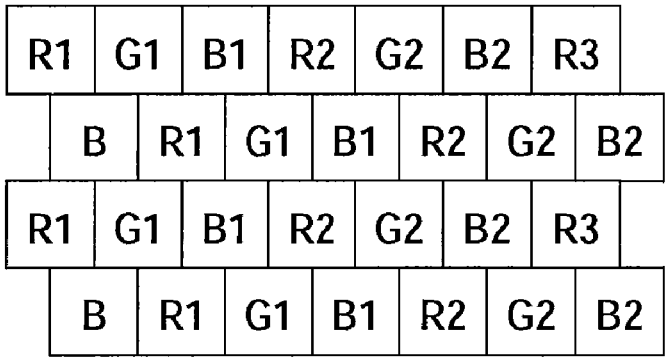
PRIOR ART FIG. 5A
FIGS. 5A and 5B are diagrams of pattern on a display screen in a delta array when processing data by using the same spatial modulation pattern in a stripe array and a delta array.
Figure 5B:
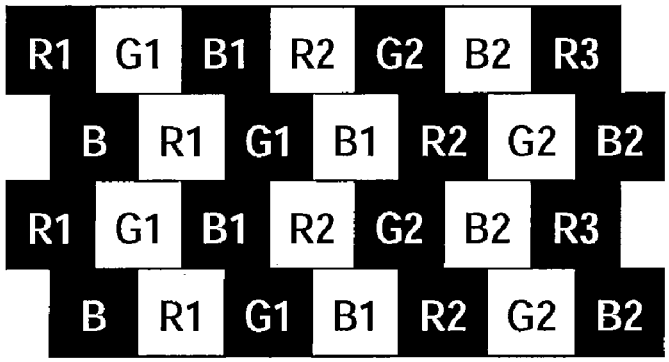
Figure 9A:
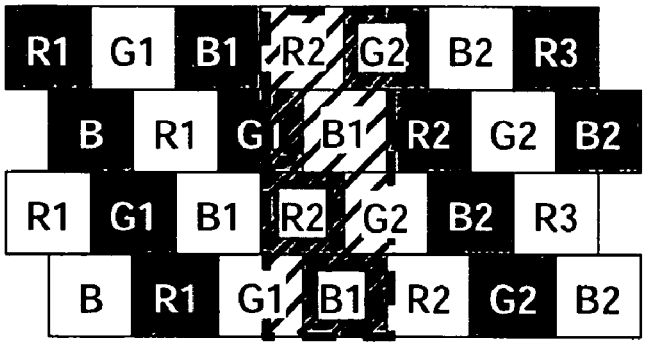
FIGS. 9A and 9B are diagrams showing an example of comparing a number of dots in the horizontal direction necessary for displaying an average luminance in a delta array.
Figure 9B:
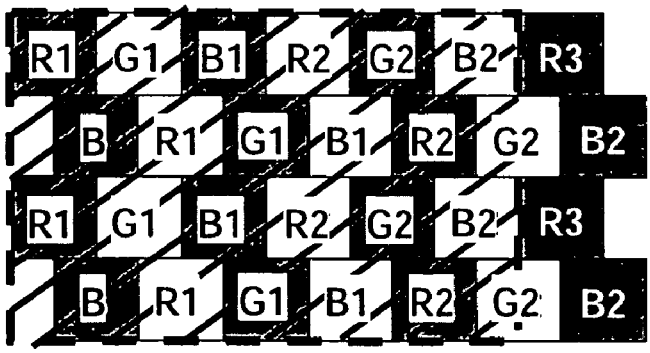
Figure 10A:
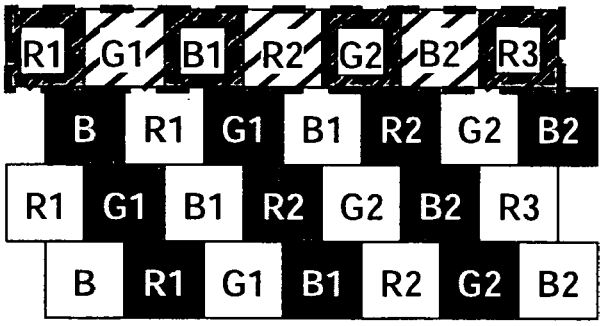
FIGS. 10A and 10B are diagrams showing an example of comparing a number of lines required for displaying the average luminance in a delta array.
Figure 10B:
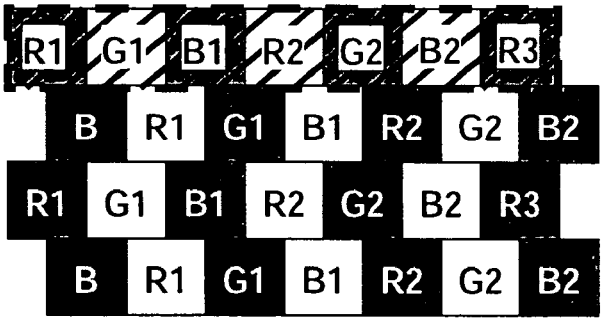

Further, FIGS. 9A and 9B and FIGS. 10A and 10B show examples comparing the number of dots in the horizontal direction and the number of lines in the vertical direction required for displaying the average luminance in delta array patterns. FIG. 9A shows a spatial modulation pattern showing the number of dots required for displaying the average luminance in the horizontal direction in the present embodiment, and FIG. 9B shows a spatial modulation pattern showing the number of dots required for displaying the average luminance in the horizontal direction in FIG. 5B. FIG. 10A shows a spatial modulation pattern showing the number of lines required for displaying the average luminance in the vertical direction in the present embodiment, and FIG. 10B shows a spatial modulation pattern showing the number of lines required for displaying the average luminance in the vertical direction in FIG. 5B.

As shown in the figures, the vertical direction can be expressed by one line in each case, but in the horizontal direction, six dots are necessary in a past pattern, while 1.5 dots are enough in the new pattern. Accordingly, in a past pattern, the result is that the spatial frequency of the horizontal direction pattern is low, and noise is generated.

Figure 12A:
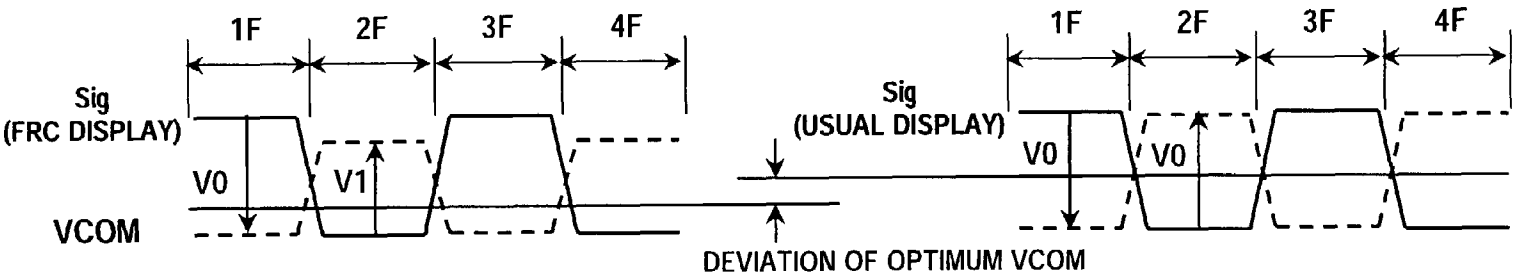
FIGS. 12A and 12B are diagrams for explaining shift of the optimum VCOM and burn-in due to a DC offset when switching the spatial modulation pattern every 1F.
Figure 12B:
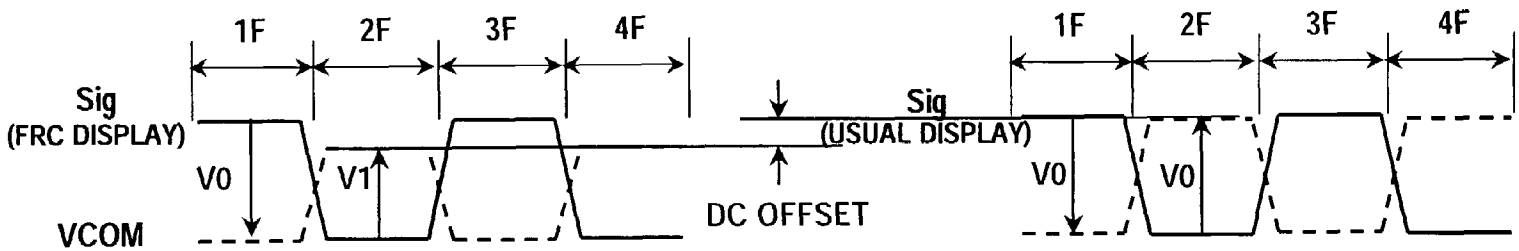

FIGS. 11A and 11B are diagrams showing relationships between a temporal modulation pattern and a VCOM polarity, in which FIG. 11A shows a case where the spatial modulation pattern is switched at every 2F (15 Hz), and FIG. 11B shows a case where the spatial modulation pattern is switched at every 1F (30 Hz). Further, FIGS. 12A and 12B are diagrams for explaining the deviation from the optimum VCOM and the occurrence of burn-in due to DC offset when switching the spatial modulation pattern at every 1F.

As shown in FIGS. 11A and 11B and FIGS. 12A and 12B, if including the polarity of the VCOM, continuous application of the potential of a constant polarity to the same pixel becomes a cause of deviation from the optimum VCOM and burn-in. Therefore, this can be avoided by switching the spatial modulation pattern at every 2F, but the frequency of the temporal modulation pattern substantially becomes 15 Hz, so flicker-like noise is generated and conspicuously recognized particularly in a case where the pixel pitch is large and a case where the difference of potentials used in the 2n gradation and the (2n+2) gradation is large. When raising the frequency of the temporal modulation pattern and switching the spatial modulation pattern at every 1F, noise is no longer recognized. However, as previously explained, this becomes the cause of deviation from the optimum VCOM and burn-in.

Therefore, the present embodiment is configured so as, as previously explained, to switch the temporal modulation pattern at 1F and change the order of application of the spatial modulation pattern at NF (N is an even number) to enable driving so that there is no deviation in the optimum VCOM in total in (2N)F and the DC offset is cancelled. At this time, if setting N to a power of 2, the circuit can be configured by only a simple frequency division circuit and the circuit configuration therefore becomes simple. Further, when N=about 128F, flickering when switching the order of application of patterns is not recognized. As explained above, optimum driving using the FRC in delta array pixels is possible without lowering the image quality.

Figures 13A, 13B, 13C:
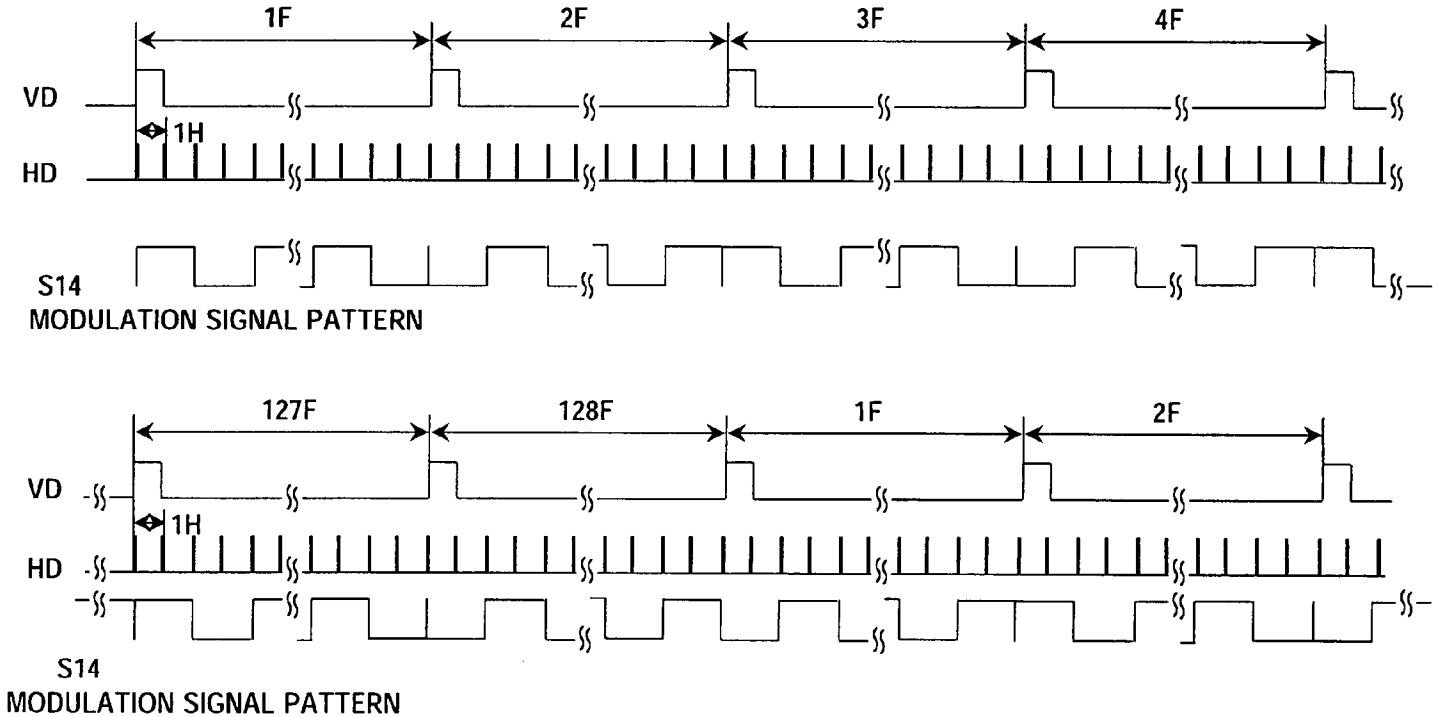
FIG. 13 is a diagram showing an example of a modulation signal pattern generated by a spatial/temporal modulation pattern generation circuit of the present embodiment.

FIGS. 13A to 13C are diagrams showing an example of a modulation signal pattern generated by the spatial/temporal modulation pattern generation circuit 14 of the present embodiment. FIG. 13A shows the vertical drive clock VD, FIG. 13B shows the horizontal drive clock HD, and FIG. 13C shows the generated modulation signal pattern. Here, an example of generating a spatial/temporal modulation pattern switching the temporal modulation pattern at 1 frame (1F) and changing the order of application of the spatial modulation pattern at 128 frames (128F) so as to enable driving so that there is no deviation in the optimum VCOM in total in 256 (2×128) frames and the DC offset is cancelled is shown.

Figure 14:
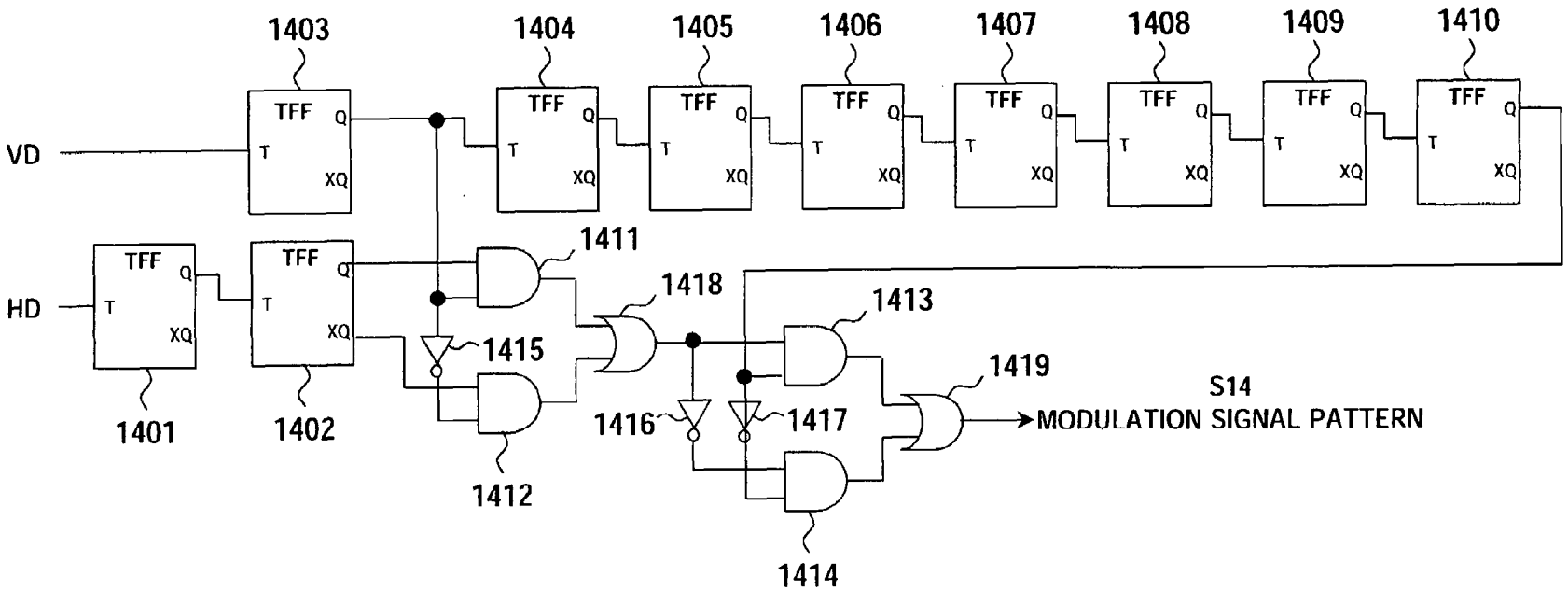
FIG. 14 is a circuit diagram showing a specific example of the configuration of the spatial/temporal modulation pattern generation circuit enabling the generation of the modulation signal pattern of the present embodiment.

FIG. 14 is a circuit diagram showing a specific example of the configuration of a spatial/temporal modulation pattern generation circuit enabling the generation of a modulation signal pattern as shown in FIG. 13C.

The spatial/temporal modulation pattern generation circuit 14 of FIG. 14 is configured by T-type flip-flops (TFF) 1401 to 1410, two-input AND gates 1411 to 1414, inverters 1415 to 1417, and two-input OR gates 1418 and 1419.

The horizontal drive clock HD is supplied to an input T of the TFF 1401, and the vertical drive clock VD is supplied to the input T of the TFF 1403. An output Q of the TFF 1401 is connected to the input T of the TFF 1402, the output Q of the TFF 1402 is connected to one input terminal of the AND gate 1411, and the XQ is connected to one input terminal of the AND gate 1412. Further, the output Q of the TFF 1403 is connected to the input T of the TFF 1404, the other input terminal of the AND gate 1411, and the input terminal of the inverter 1415, and the output terminal of the inverter 1415 is connected to the other input terminal of the AND gate 1412. The output terminal of the AND gate 1411 is connected to one input terminal of the OR gate 1418, and the output terminal of the AND gate 1412 is connected to the other input terminal of the OR gate 1418. The output terminal of the OR gate 1418 is connected to one input terminal of the AND gate 1413 and the input terminal of the inverter 1416. The TFFs 1404 to 1410 are cascade connected to the output Q of the TFF 1403. The output Q of the TFF 1410 at the last stage is connected to the other input terminal of the AND gate 1413 and the input terminal of the inverter 1417. The output terminal of the inverter 1416 is connected to one input terminal of the AND gate 1414, and the output terminal of the inverter 1417 is connected to the other input terminal of the AND gate 1414. The output terminal of the AND gate 1413 is connected to one input terminal of the OR gate 1419, and the output terminal of the AND gate 1414 is connected to the other input terminal of the OR gate 1419.

In the spatial/temporal modulation pattern generation circuit 14 of FIG. 14, due to the TFFs 1401 and 1402, the temporal modulation pattern as shown in FIG. 13C is generated by dividing the frequency of the horizontal drive clock HD by two. In synchronization with the vertical division clock VD receiving as input this for each frame, the temporal modulation pattern is switched by the TFF 1403, the AND gates 1411 and 1412, the inverter 1415, the OR gate 1418, etc. The temporal modulation pattern is switched at 1 frame (1F) and the order of application of the spatial modulation pattern is changed at 128 frames (128F) by logical computation of the output of the OR gate 1418 and the output of the TFF 1410 by the AND gates 1413 and 1414, the inverters 1416 and 1417, and the OR gate 1419. This spatial/temporal modulation pattern generation circuit 14 generates the modulation signal pattern S14 of FIG. 13C so that the gradation to be assigned is switched at every 2H and switched at every 1F from FIG. 8 and is switched at every 128F when paying attention to a certain data line.

The FRC data processing circuit 15 generates the dot modulation signal pattern DMP based on the modulation signal pattern S14 supplied from the spatial/temporal modulation pattern generation circuit 14 in synchronization with the master clock MCK, applies this dot modulation pattern to the digital image data DT input from the outside to generate the modulated data S15, and supplies the same to the horizontal drive circuit 13.

Figure 15:
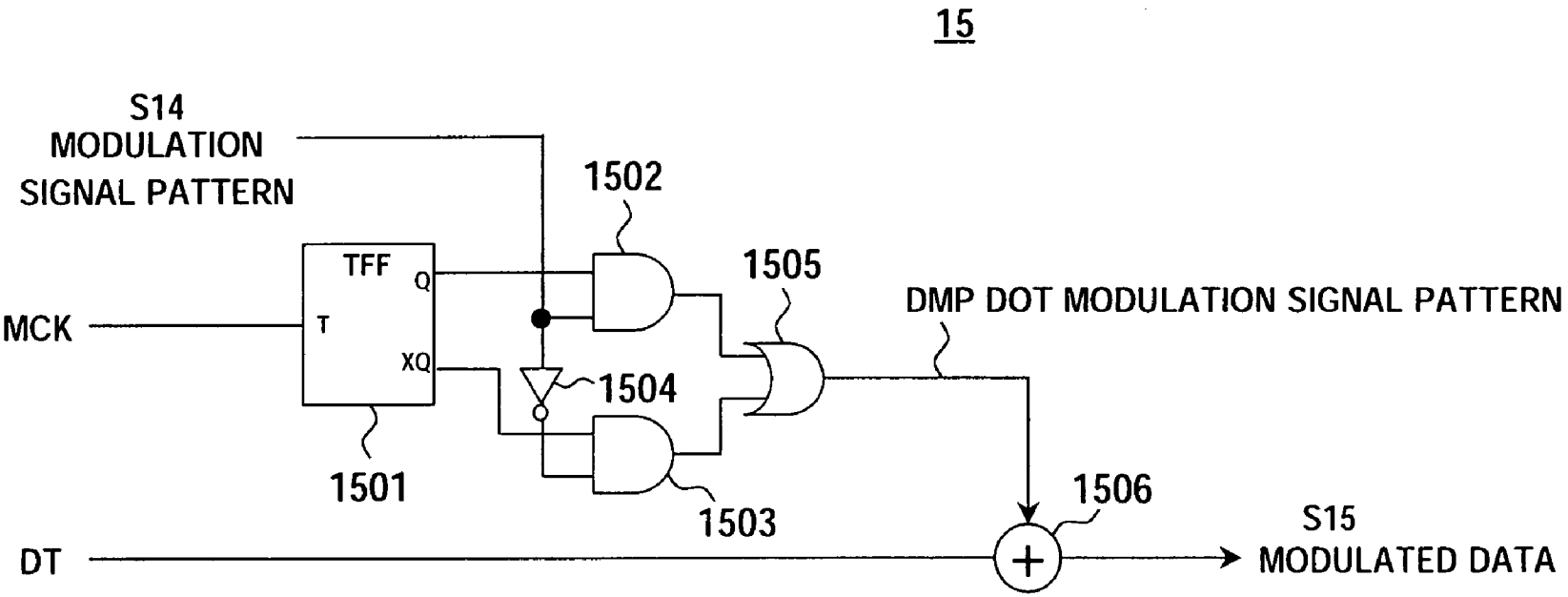
FIG. 15 is a circuit diagram showing a specific example of the configuration of an FRC data processing circuit of the present embodiment.
Figures 16A, 16B, 16C, 16D, 16E:
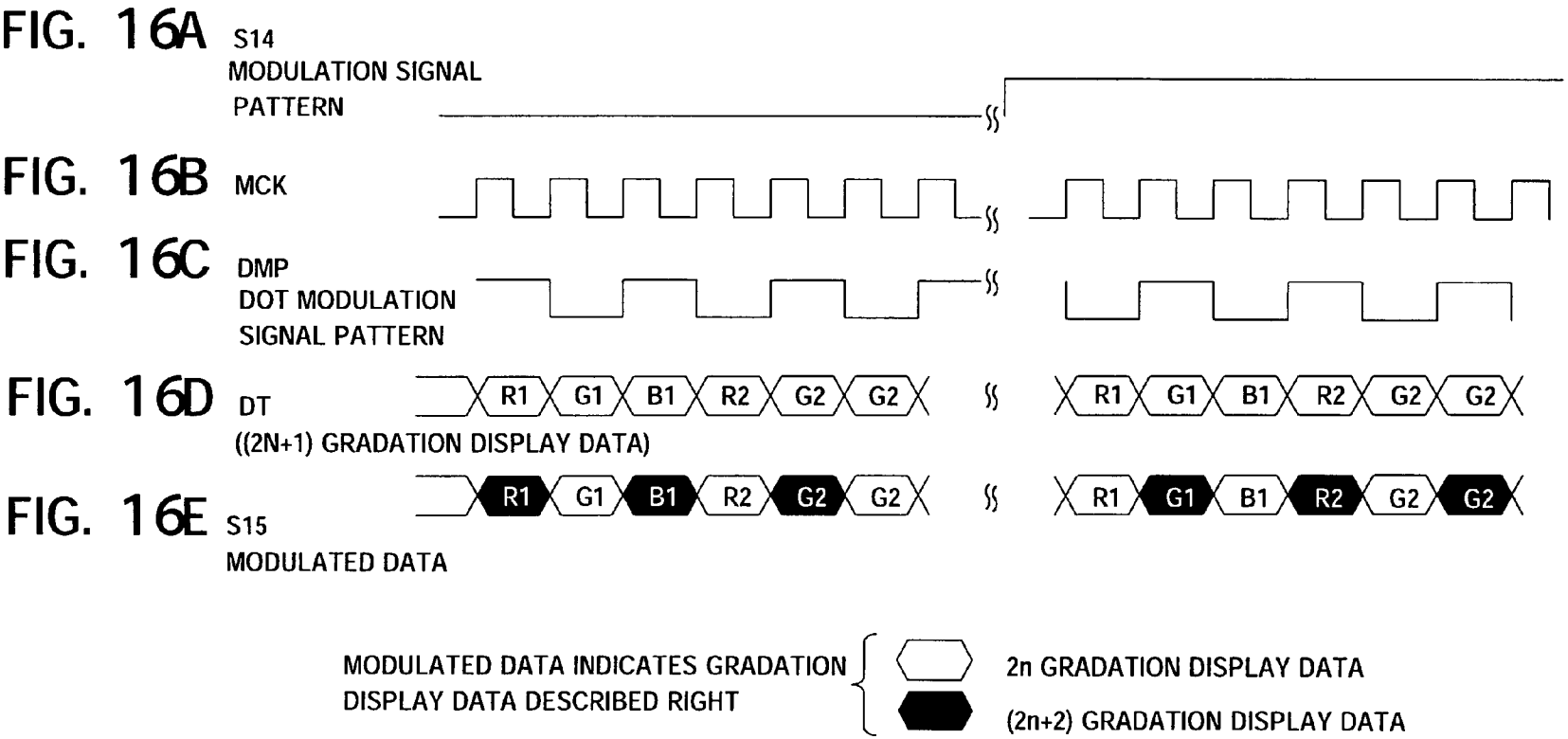
FIGS. 16A to 16E are timing charts of the FRC data processing circuit of FIG. 15.

FIG. 15 is a circuit diagram showing a specific example of the configuration of the FRC data processing circuit 15 of the present embodiment. Further, FIGS. 16A to 16E are timing charts of the FRC data processing circuit of FIG. 15. FIG. 16A shows the modulation signal pattern S14, FIG. 16B shows the master clock MCK, FIG. 16C shows the dot modulation signal pattern DMP, FIG. 16D shows the input digital image data DT, and FIG. 16E shows the output modulation data S15.

The FRC data processing circuit 15 of FIG. 15 is configured by a TFF 1501, two-input AND gates 1502 and 1503, an inverter 1504, a two-input OR gate 1505, and an adder 1506.

The master clock MCK is supplied to the input T of the TFF 1501, and the output Q of the TFF 1501 is connected to first input terminals of the AND gates 1502 and 1503. The other input terminal of the AND gate 1502 and the input terminal of the inverter 1504 are connected to a supply line of the modulation signal pattern S14, and the output terminal of the inverter 1504 is connected to the other input terminal of the AND gate 1503. The output terminal of the AND gate 1502 is connected to one input terminal of the OR gate 1505, and the output terminal of the AND gate 1503 is connected to the other input terminal of the OR gate 1505. The adder 1506 is supplied with the digital image data DT and the dot modulation signal pattern DMP output from the OR gate 1505.

This FRC data processing circuit 15, as shown in FIGS. 16A to 16E, generates a clock combined with the frequency division clock of the master clock MCK, that is, the dot modulation signal pattern DMP, so as to be assigned for each data so as to correspond to the pattern of FIG. 8, adds that to the data DT to modulate (2n) gradation display data to (2n+2) gradation display data, and sends this to the horizontal drive circuit 13.

Next, the operation of the circuit of FIG. 6 will be explained.

The spatial/temporal modulation pattern generation circuit 14 is supplied with the horizontal drive clock HD at every 1H and is supplied with the vertical drive clock VD at every 1 frame. In the spatial/temporal modulation pattern generation circuit 14, processing is performed switching the temporal modulation pattern at 1 frame (1F) and changing the order of application of the spatial modulation pattern at 128 frames in synchronization with the horizontal drive clock HD supplied for every 1H and the vertical drive clock VD supplied for every 1F and, as a result, a spatial/temporal modulation pattern enabling driving so that there is no deviation in the optimum VCOM in total in (2×128) frames and the DC offset is cancelled is generated and is supplied as the modulation signal pattern S14 to the FRC data processing circuit 15.

The FRC data processing circuit 15 receives the modulation signal pattern S14 from the spatial/temporal modulation pattern generation circuit 14 and generates the dot modulation signal pattern DMP as a clock combined with the frequency division clock of the master clock MCK so as to be assigned for each data. Then, the generated dot modulation signal pattern DM is added to the digital image data DT at the input. Due to this, the (2n) gradation display data is modulated to (2n+2) gradation display data and transmitted to the horizontal drive circuit 13.

Further, the vertical drive circuit 12 sequentially generates the vertical selection pulses in synchronization with the vertical transfer clock VCK and applies the pulses to the vertical scanning lines SCL1 to SCL3 for the vertical scanning. Then, the horizontal drive circuit 13 sequentially outputs the shift pulses from transfer stages in synchronization with the horizontal transfer clock HCK in the shift register for the horizontal scanning. The sampling latch circuit samples and latches predetermined bits of digital image data given by the FRC data processing circuit 15 in point sequence in response to the sampling pulses from the shift register. Next, the line sequencing latch circuit latches the digital image data latched in the point sequence again in line units for the line sequencing, and the DAC converts one line's worth of the digital image data to an analog image signal and outputs it to the corresponding data lines DTL1 to DTL4.

Due to this, in the delta array pixel liquid crystal display device 10 using FRC to alternately display a 2n gradation and a (2n+2) gradation to display a (2n+1) gradation, an image is displayed without noise, without deviation of the optimum VCOM, and without burn-in by using the optimum spatial modulation pattern.

Figure 17A:
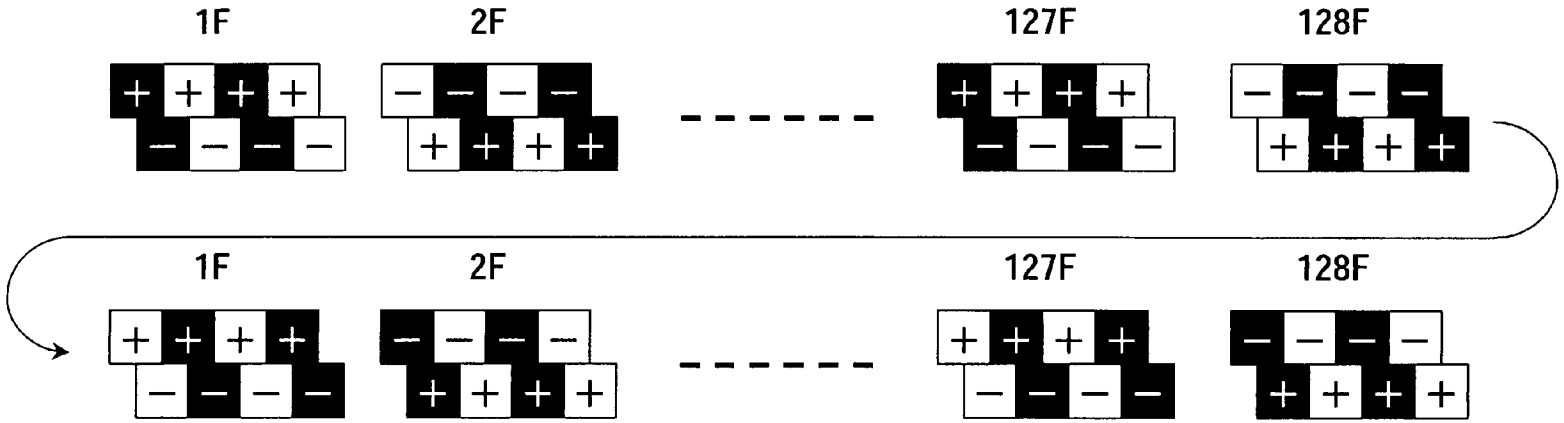
FIGS. 17A and 17B are diagrams showing a temporal modulation pattern switching a spatial modulation pattern every 1F and changing an order of application of the pattern every 128F and a state of VCOM in the present embodiment.
Figure 17B:
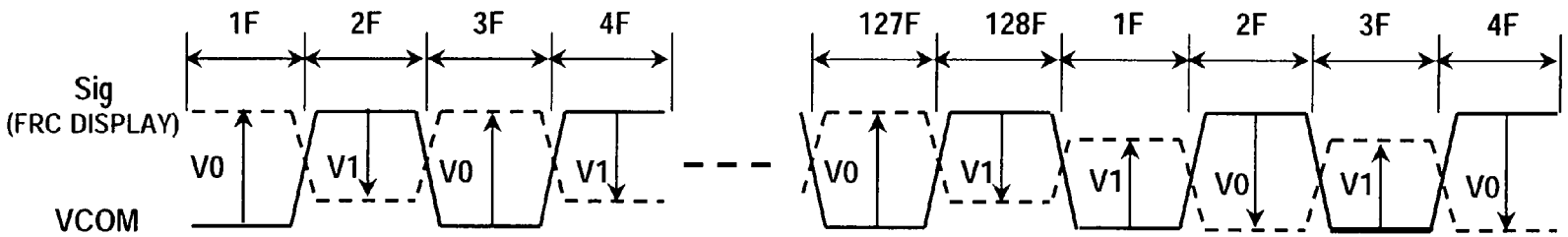

FIGS. 17A and 17B are diagrams showing a temporal modulation pattern switching the spatial modulation pattern at every 1F and switching the order of application of the pattern at every 128F and the state of the VCOM in the present embodiment, in which FIG. 17A shows the temporal modulation pattern, and FIG. 17B shows the state of VCOM.

As shown in FIG. 17, by switching the spatial modulation pattern at every 1F and switching it at every NF, an image can be displayed without noise, without deviation of the optimum VCOM, and without burn-in.

As explained above, according to the present embodiment, provision is made of the spatial/temporal modulation pattern generation circuit 14 for generating a spatial/temporal modulation pattern switching the temporal modulation pattern at 1F and changing the order of application of the spatial modulation pattern at NF (N is an even number) in synchronization with a horizontal drive clock HD supplied at every 1H and a vertical drive clock VD supplied at every 1F so as to enable driving so that there is no deviation in the optimum VCOM in total in (2N)F and the DC offset is cancelled and the FRC data processing circuit 15 for generating the dot modulation signal pattern DMP based on the modulation signal pattern S14 supplied by the spatial/temporal modulation pattern generation circuit 14 in synchronization with the master clock MCK, adding this dot modulation pattern to the digital image data DT input from the outside, generating the modulated data S15, and supplying the same to the horizontal drive circuit 13, therefore the following effects can be obtained.

Namely, in a delta array pixel display device using FRC to alternately display a 2n gradation and a (2n+2) gradation to display a (2n+1) gradation, display without noise is possible by using the optimum spatial modulation pattern. Further, in stripe and delta array pixel display devices using the FRC method to alternately display a 2n gradation and a (2n+2) gradation to display a (2n+1) gradation, by using the optimum temporal modulation pattern, there is the advantage that display without noise, without deviation of the optimum VCOM, and without burn-in is possible. Further, there is no need to use a sophisticated spatial modulation pattern, so therefore a memory that changes the spatial modulation pattern for each field or generates it at random etc. is unnecessary.

It should be understood by those skilled in the art that various modifications, combinations, sub-combinations, and alterations may occur depending on design requirements and other factors insofar as they are within the scope of the appended claims or the equivalents thereof.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device of predetermined array pixels displaying a (2n+1) gradation by alternately displaying a 2n gradation and a (2n+21) gradation, comprising:

a modulation pattern generation circuit for generating a spatial/temporal modulation pattern switching a temporal modulation pattern every frame (F) and changing an order of application of a spatial modulation pattern every NF, where N is an even number, such that the spatial modulation pattern applied in every (N+1)F is the same as the spatial modulation pattern applied in every NF;

a data processing circuit for modulating image data in accordance with the modulation pattern generated by the modulation pattern generation circuit; and a drive circuit for driving the display in accordance with the modulated data of the data processing circuit.

2. A display device as set forth in claim 1, wherein the modulation pattern generation circuit switches the temporal modulation pattern every frame and changes the order of application of the spatial modulation pattern every NF, where N is an even number, in synchronization with a horizontal drive clock supplied for every horizontal period (H) and a vertical drive clock supplied for every frame (F).

3. A display device as set forth in claim 1, wherein the data processing circuit generates a dot modulation signal pattern based on the modulation pattern supplied by the modulation pattern generation circuit in synchronization with a predetermined clock and adds the dot modulation pattern to the input image data to generate modulated data.

4. A display device as set forth in claim 1, wherein the modulation pattern generation circuit switches the temporal modulation pattern every frame and changes the order of application of the spatial modulation pattern every NF, where N is an even number, in synchronization with a horizontal drive clock supplied for every horizontal period (H) and a vertical drive clock supplied for every frame (F), and the data processing circuit generates a dot modulation signal pattern based on the modulation pattern supplied by the modulation pattern generation circuit in synchronization with a predetermined clock and adds the dot modulation pattern to the input image data to generate modulated data.

5. A display device of predetermined array pixels displaying a (2n+1) gradation by alternately displaying a 2n gradation and a (2n+2) gradation, comprising:

a display unit in which pixels including liquid crystal cells are arrayed in a matrix and the pixels are connected to a data line;

a modulation pattern generation circuit for generating a spatial/temporal modulation pattern switching a temporal modulation pattern every frame (F) and changing an order of application of a spatial modulation pattern every NF, where N is an even number, such that the spatial modulation pattern applied in every (N+1)F is the same as the spatial modulation pattern applied in every NF;

a data processing circuit for modulating image data in accordance with the modulation pattern generated by the modulation pattern generation circuit; and a drive circuit for driving the display by driving the data line in accordance with the modulated data of the data processing circuit.

6. A display device as set forth in claim 5, wherein the modulation pattern generation circuit switches the temporal modulation pattern every frame and changes the order of application of the spatial modulation pattern every NF, where N is an even number, in synchronization with a horizontal drive clock supplied for every horizontal period (H) and a vertical drive clock supplied for every frame (F).

7. A display device as set forth in claim 5, wherein the data processing circuit generates a dot modulation signal pattern based on the modulation pattern supplied by the modulation pattern generation circuit in synchronization with a predetermined clock and adds this dot modulation pattern to the input image data to generate modulated data.

8. A display device as set forth in claim 5, wherein the modulation pattern generation circuit switches the temporal modulation pattern every frame and changes the order of application of the spatial modulation pattern every NF, where N is an even number in synchronization with a horizontal drive clock supplied for every horizontal period (H) and a vertical drive clock supplied for every frame (F), and the data processing circuit generates a dot modulation signal pattern based on the modulation pattern supplied by the modulation pattern generation circuit in synchronization with a predetermined clock and adds this dot modulation pattern to the input image data to generate modulated data.

9. A display method of predetermined array pixels displaying a (2n+1) gradation by alternately displaying a 2n gradation and a (2n+21) gradation, comprising:

generating a spatial/temporal modulation pattern switching a temporal modulation pattern every frame (F) and changing an order of application of the spatial modulation pattern every NF, where N is an even number, such that the spatial modulation pattern applied in every (N+1)F is the same as the spatial modulation pattern applied in every NF;

modulating the image data in accordance with the generated modulation pattern, and driving the display in accordance with the modulated data.

* * * * *